US005875870A

United States Patent [19]

Lee

[11] Patent Number: 5,875,870

[45] Date of Patent: Mar. 2, 1999

[54] ESCAPE LADDER SYSTEM

[76] Inventor: Kenten Lee, 5F, No. 8-37, Lung Hsing Rd., Pa Li, Taipei Hsien, Taiwan

[21] Appl. No.: 906,903

[22] Filed: Aug. 6, 1997

[51] Int. Cl.[6] ..... A62B 1/06

[52] U.S. Cl. ..... 182/70; 182/74; 182/95

[58] Field of Search ..... 182/70, 73, 74, 182/75, 76, 85, 95, 96, 160, 195

[56] References Cited

U.S. PATENT DOCUMENTS

| | | | |
|---|---|---|---|
| 261,847 | 8/1882 | Graff | 182/70 |
| 280,527 | 7/1883 | Smiley | 182/70 |
| 389,696 | 9/1888 | Fink | 182/95 |
| 1,218,828 | 3/1917 | Barber et al. | 182/70 |
| 2,210,182 | 8/1940 | Schultz et al. | 182/74 |
| 2,513,835 | 7/1950 | Allen | 182/70 |
| 3,143,186 | 8/1964 | Bourdunis | 182/95 |
| 3,997,026 | 12/1976 | Riehlmann | 182/70 X |
| 5,022,491 | 6/1991 | Gill | 182/70 X |
| 5,303,799 | 4/1994 | Tsai | 182/70 X |
| 5,311,965 | 5/1994 | Wu | 182/74 X |
| 5,372,217 | 12/1994 | Hsu | 182/70 |
| 5,605,203 | 2/1997 | Chang | 182/95 X |

*Primary Examiner*—Daniel P. Stodola
*Assistant Examiner*—Bruce A. Lev
*Attorney, Agent, or Firm*—Rosenberg, Klein & Bilker

[57] ABSTRACT

An escape ladder system generally comprising a housing having an inner chamber; a collapsible ladder unit assembly removably received in the housing inner chamber; a cover plate removably coupled to the housing; and, a control unit assembly coupled to the ladder unit assembly. When in its collapsed configuration, the ladder unit assembly is retained by the control unit assembly within the housing inner chamber. The ladder unit assembly is biased for displacement from the housing inner chamber and extension into its extended configuration responsive to appropriate user actuation of the control unit assembly.

4 Claims, 6 Drawing Sheets

ESCAPE LADDER SYSTEM

BACKGROUND OF THE INVENTION

The subject invention relates to a structural improvement of escape ladder, particularly to an escape ladder structure that can be easily operated and rapidly installed without causing bad effects on a building's appearance.

DESCRIPTION OF PRIOR ART

Conventionally, the prior art of escape ladder equipment, such as disclosed in domestic Patent Gazette, serial Nos. 248055, 227262 and 198377, is designed to assist people to escape a hazardous place in case of fire or other emergencies; but such escape ladders would inevitably involve some weaknesses, such as its storage that would seriously influence a building's appearance, and complicated operational procedures that make rapid installation of the escape ladder within a shortest time simply impossible, and subsequent difficulty in its promotion, etc. which cannot be accepted by the consumers.

Therefore, as can be understood from the above, the prior art of escape ladder does involve some inconveniences and weaknesses in the sense of actual applications, that need further improvement.

In view of the above weaknesses that need improvement, the subject inventor has devoted much time and effort in the research, assisted by theoretical applications, and has finally presented a reasonably designed subject invention that will be able to effectively address the above weaknesses.

SUMMARY OF THE INVENTION

The primary purpose of the subject invention is to provide a type of structural improvement of escape ladder system, comprising a length extendable and retractable ladder unit composed of a main ladder and an auxiliary ladder; when not in use, it can be accommodated in the hollow interior of a housing; and when it is to be used, a control unit will enable the ladder unit to automatically slide out and extend by means of its own gravitational force; its operational procedures are quite simple, and its extension and installation can be accomplished rapidly within a shortest time, to gain sufficient time for escape, and to minimize casualties; and when it is not in use, it can be integrally accommodated in the housing, and sealed by a cover plate, so it will not cause bad influence on a building's appearance.

To enable better understanding, the technical approaches and effects employed in the subject invention to achieve the above purpose and configuration are described in details below with drawings of preferred embodiment:

Brief Description of Numerals

| | | | |
|---|---|---|---|
| 10 | housing | 11 | ladder unit |
| 12 | control unit | 13 | hollow interior |
| 14 | main ladder | 15 | auxiliary ladder |
| 16 | side rail | 17 | rung |
| 18 | side rail | 19 | rung |
| 20 | slide channel | 21 | stop block |
| 22 | stop block | 23 | support lever |
| 24 | press pad | 25 | linked lever |
| 26 | catch lever | 27 | toggle lever |
| 28 | fulcrum | 29 | push lever |
| 30 | penetrated hole | 31 | positioning recess |
| 32 | stop lever | 33 | catch groove |
| 33a | level part | 33b | vertical part |
| 34 | screw | 35 | cover plate |
| 36 | penetrated hole | 37 | head |
| 38 | spring | | |

DETAILED DESCRIPTION OF PREFERRED EMBODIMENT

Figure 1:
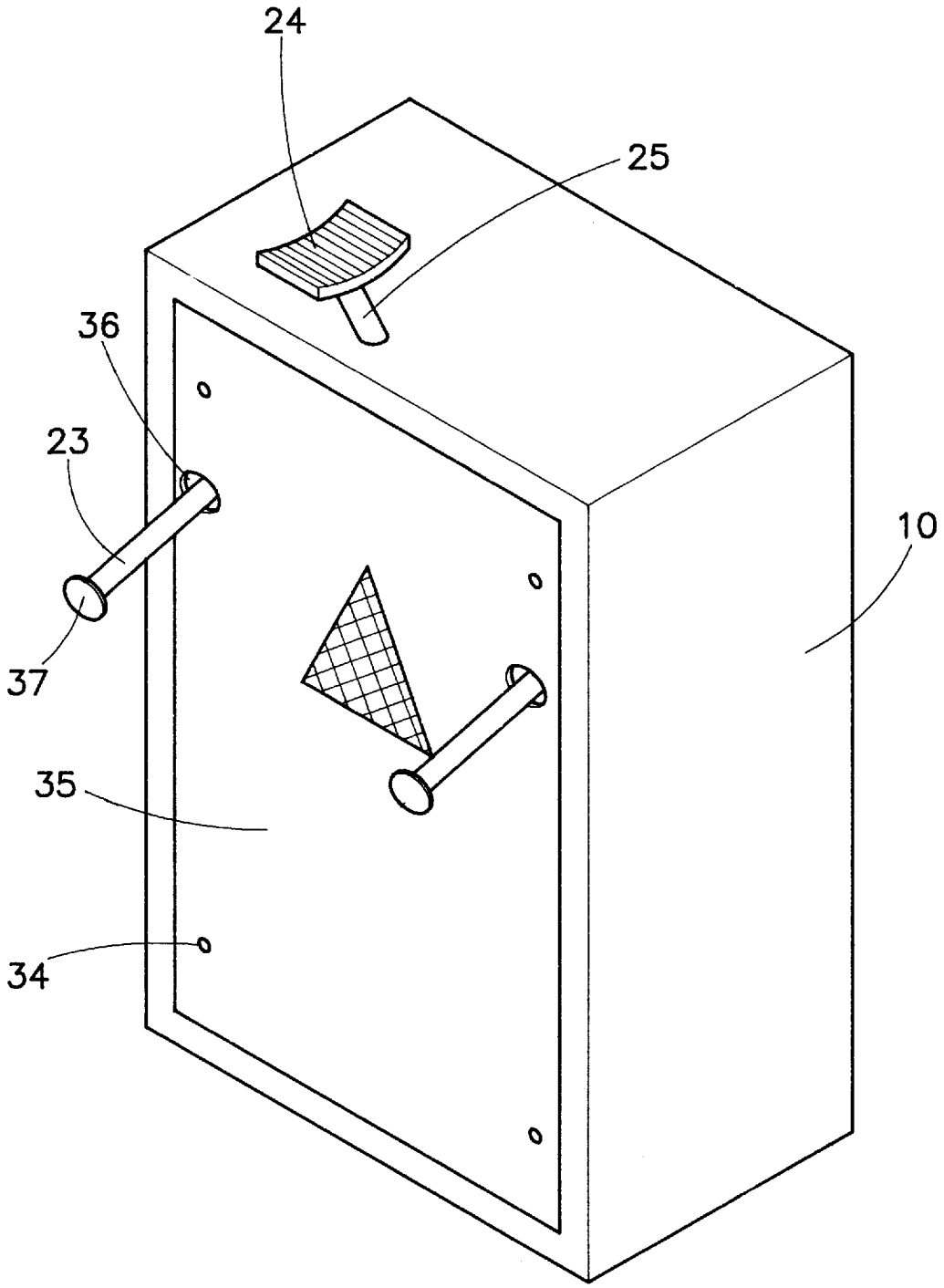
FIG. 1 is an exterior view of the subject invention.
Figure 2:
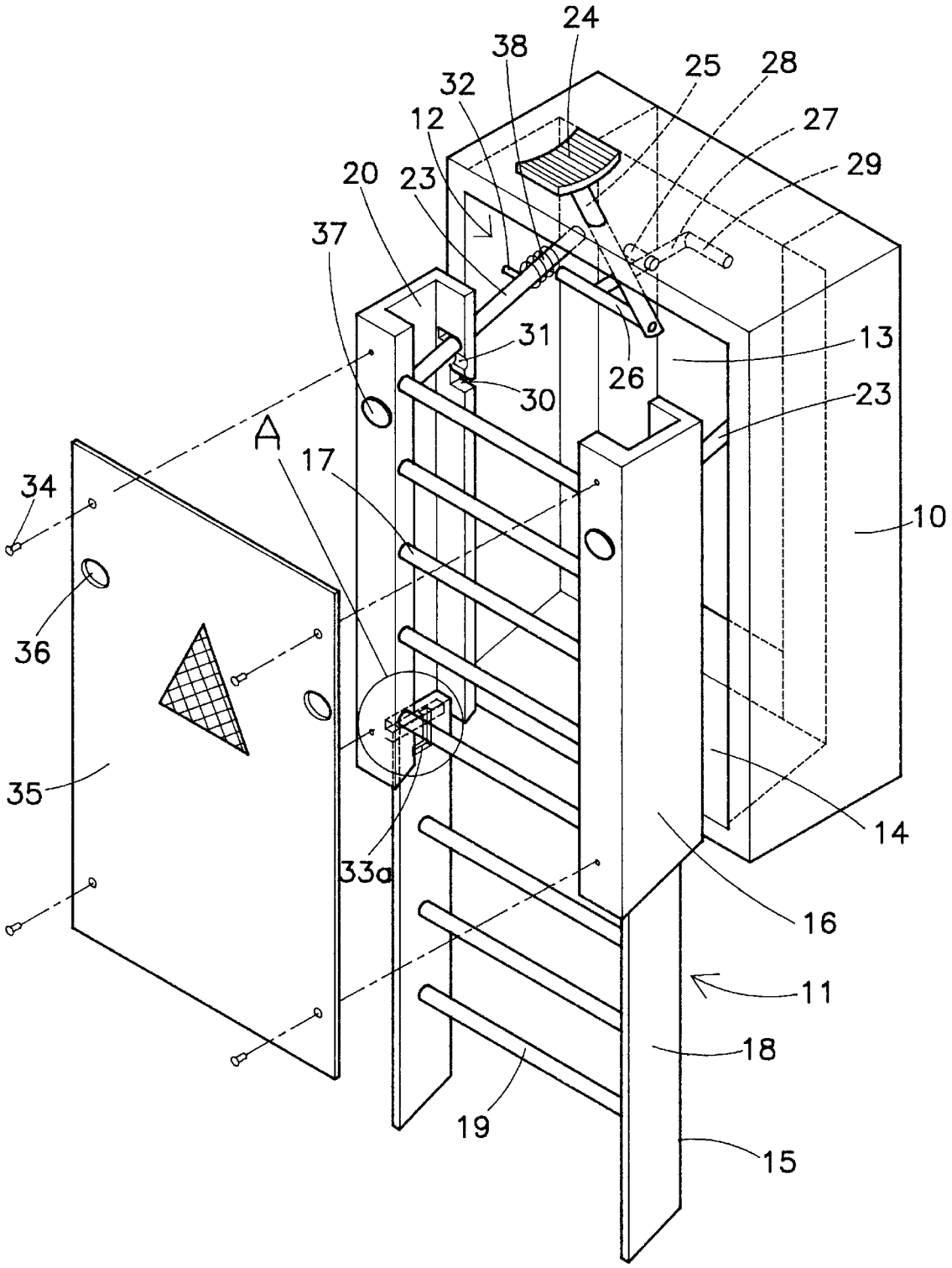
FIG. 2 is an exploded view of the subject invention.
Figure 2A:
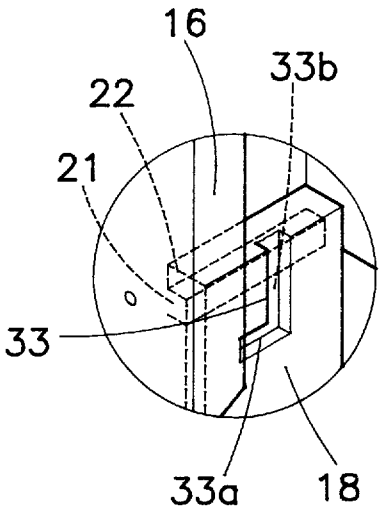
FIG. 2A is a detailed perspective view, partially cut-away, of a portion of the view shown in FIG. 2.
Figure 3:
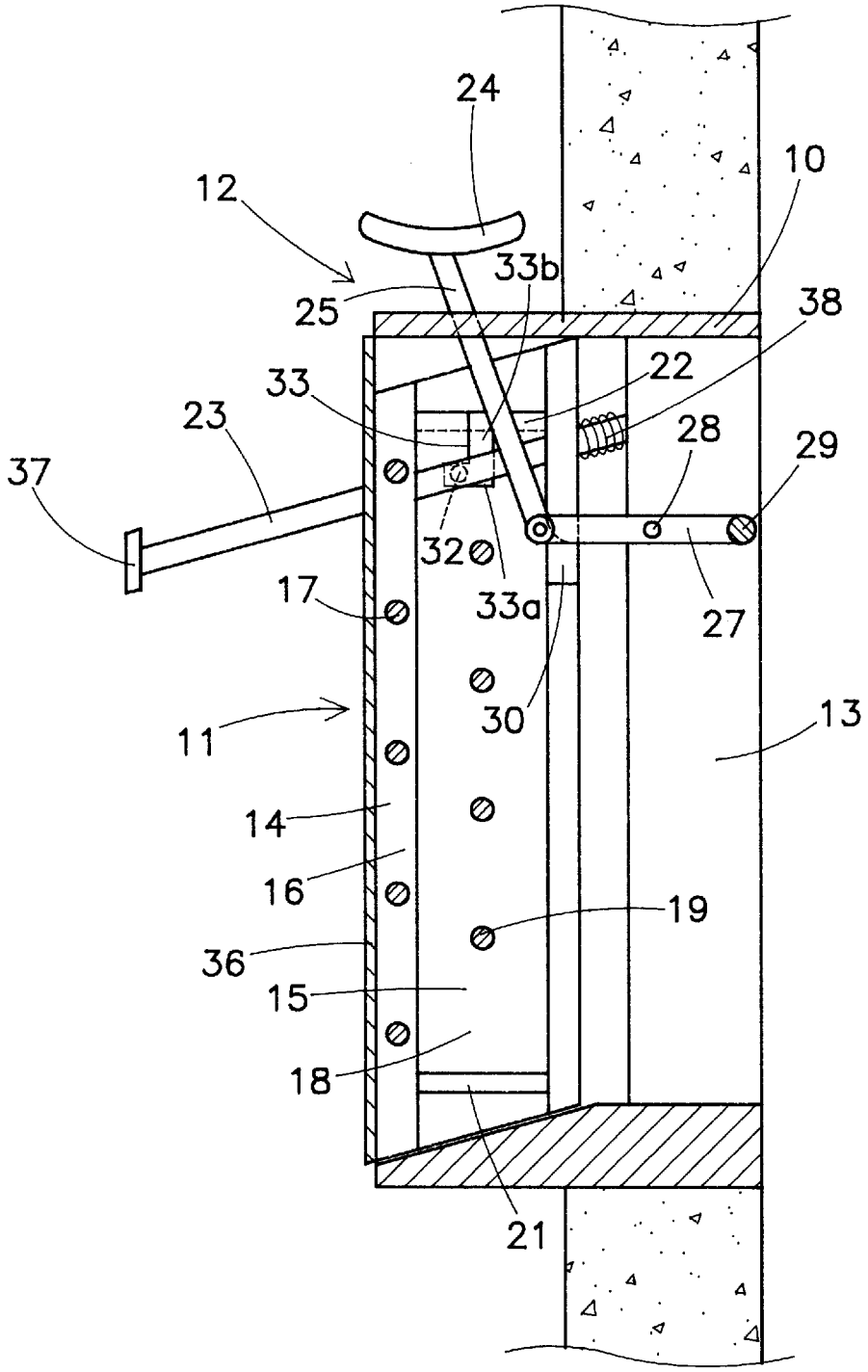
FIG. 3 is a side sectional view of the subject invention.

FIGS. 1, 2 and 3 are respectively an exterior view, an exploded view and a side sectional view of the subject invention. The subject invention relates to the providing of a structural improvement of escape ladder system, comprising a housing 10, a ladder 11 unit and a control unit; wherein, the housing 10 is a through hollow housing that may be fixed on the wall or other appropriate locations in a building, whereas the hollow interior of the housing 10 constitutes an access to escape.

Figure 4:
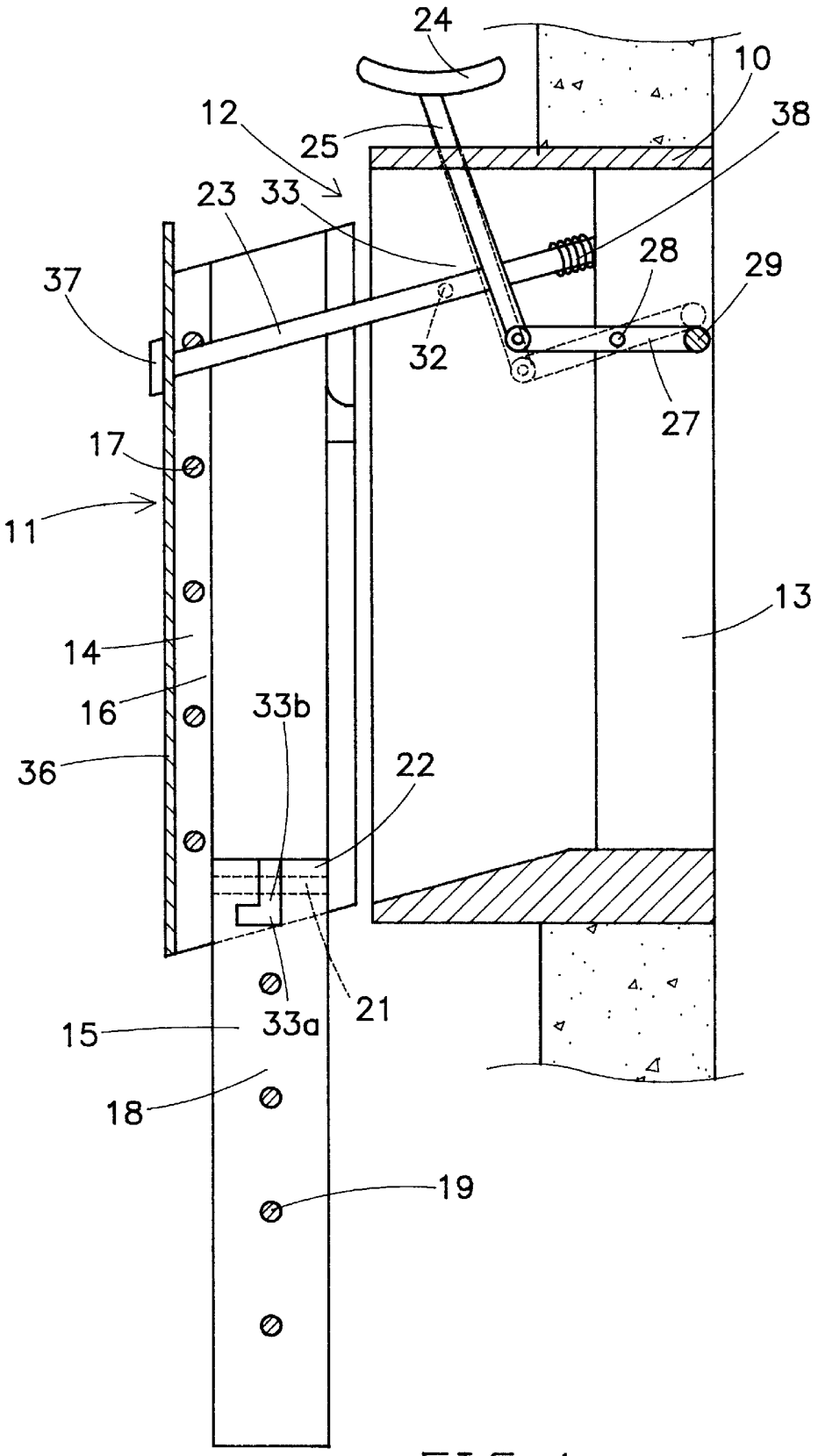
FIG. 4 is a front view of a part of the subject invention.

The ladder unit 11 is a length extendable and retractable structure that may be retracted and stored in the hollow interior 13 of the housing 10; said ladder unit is composed of a main ladder 14 and an auxiliary ladder 15; between the two side rails 16 of the main ladder 14 are several rungs 17; likewise, between the two side rails 18 of the auxiliary ladder 15 are also several rungs 19; the insides of the two side rails 16 of the main ladder 14 are so shaped to form slide channels 20, to accommodate the two side rails 18 of the auxiliary ladder 15 sliding into the insides of the two side rails 16 of the main ladder 14. When the auxiliary ladder 15 is accommodated inside the main ladder 14, they constitute a shortened ladder unit 11 that may be stored in the hollow interior 13 in the housing 10; when the auxiliary ladder 15 extends out of the main ladder 14, they constitute a extended ladder unit 11 to enable climbing for escape. On the bottom ends of the two side rails 16 of the main ladder 14 and on the top ends of the two side rails 18 of the auxiliary ladder 15 are respectively stop blocks 21 and 22 (as illustrated in FIG. 4), so that when the auxiliary ladder 15 extends downward to its position, the stop blocks 21 and 22 will stop it in position, and prevent the auxiliary ladder 15 from moving further down and apart from the main ladder 14.

The control unit 12 comprises two inclined support levers 23 in the housing 10; the front ends of the two support levers 23 protrude an appropriate length into the housing 10; the two support levers 23 penetrate through the two side rails 16 of the main ladder 14 of the ladder unit 11; the two support levers 23 and the two side rails 16 are linked in a sliding mechanism; since the support levers 23 are inclined, the ladder unit 11 supported by the support levers 23 will slide forward, owing to gravitational effect, so the ladder unit 11 will automatically slide to the front of the housing 10; on the front ends of the two support levers 23 are larger heads 37 that are so designed to prevent the ladder unit 11 from sliding forward and out of engagement with the support levers 23. On the two support levers 23 there may be springs 38 to push the ladder unit 11; so when the ladder unit 11 is to be used, the springs 38 may push the ladder unit 11 to slide out quickly, in addition to its gravitational force.

The control unit 12 comprises a press pad 24; said press pad 24 is located outside the housing 10; the bottom of the press pad is connected to a linked lever 25; the lower end of the linked lever 25 penetrates into the housing 10, and is joined to a catch lever 26; the catch lever 26 is joined to the front end of a toggle lever 27; said toggle lever 27 is hinge joined to a fulcrum 28; the fulcrum 28 is fixed to the housing 10. When the press pad 24 is depressed, the linked lever 25 will drive the catch lever 26 to move downward; the catch lever moves on the fulcrum 28 as its fulcrum. The rear end of the toggle lever 27 is joined to a push lever 29; when the push lever 29 is pushed upward, the catch lever 26 on the front of the toggle lever 27 will move downward, with the fulcrum 28 serving as a fulcrum. Said press pad 24 and the push lever 29 are both the components to drive the control unit 12, which will be used will depend on the position of the escapee on the outside top of the housing 10 or inside the housing 10; in case the escapee arrives at the outside top of the housing from an upper floor, the press pad 24 will be used to drive the control unit 12; in case the escapee tries to escape from inside a room through the hollow interior 13 in the housing 10, then, the push lever 29 will be used to drive the control unit 12.

On one side rail 16 of the main ladder 14 of the ladder unit 11 is a penetrated hole 30; in the penetrated hole 30 is a positioning recess 31; when the auxiliary ladder 15 is accommodated inside the main ladder 14 to become a shortened ladder unit 11, the ladder unit 11 may be pushed back along the two support levers 23, so the penetrated hole 30 on the side rail 16 of the main ladder 14 is penetrated by the catch lever 26, so the catch lever 26 is arrested in the positioning recess 31 on the side rail 16; so designed to prevent the ladder unit 11 on the support levers 23 from sliding out of the housing 10 due to its gravitational force, and so the ladder unit 11 may be accommodated in the hollow interior 13 in the housing 10. On the outside of the two support levers 23 are respectively a protruding stop lever 32; and on the top ends of the auxiliary ladder 15 of the ladder unit 11 are corresponding catch grooves 33; said catch grooves 33 are L-shaped. When the auxiliary ladder 15 is accommodated inside the main ladder 14, and the ladder unit 11 is accommodated in the hollow interior 13 in the housing 10, the stop levers 32 outside the two support levers 23 are also accommodated in the level parts 33*a* (as illustrated in FIG. 3) below the catch grooves 33 at the top ends of the auxiliary ladder 15; so the auxiliary 15 will not slide down to extend itself, because it is stopped by the stop levers 32. When the ladder unit 11 is moved out of the housing 10, the stop levers 32 on the outsides of the two support levers 23 are located at the vertical parts 33*b* in the catch grooves 33 at the top ends of the auxiliary ladder 15, so the auxiliary ladder is not stopped by the stop levers 32, so it will slide down to extend itself (as illustrated in FIG. 5).

To the front of the main ladder 14 of the ladder unit 11 is a cover plate 35 that is fixed tight by several screws 34; said cover plate 35 corresponds to the hollow interior 13 of the housing 10; on the cover plate 35 are two penetrated holes 36 to be penetrated by the two support levers 23. When the ladder unit 11 is accommodated in the hollow interior 13 of the housing 10, the cover plate 35 securely seals the front opening of the hollow interior 13, for the sake of a good-looking exterior.

Figure 5:
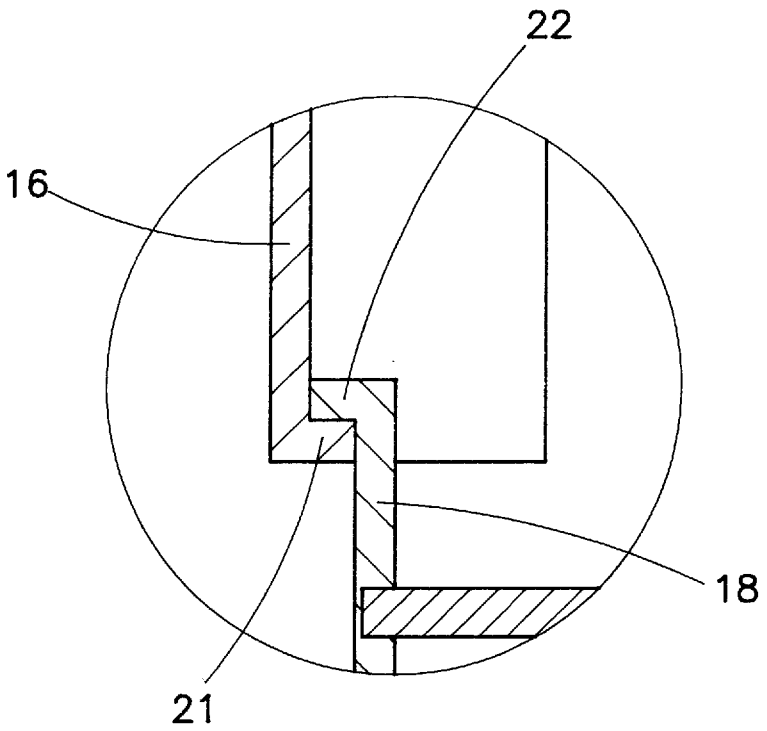
FIG. 5 is a side sectional view of the subject invention in operation.

FIG. 5 is a side sectional view of the subject invention in operation. When the subject invention is to be used, the location of the escapee whether on the outside top of the housing 10 or inside the housing 10 will determine the selection of the press pad 24 or the push lever 29 to drive the control unit 12; when the press pad 24 or the push lever 29 is used to drive the control unit 12, the toggle lever 27 will move in a counterclockwise direction with the fulcrum 28 serving as its fulcrum, so the catch lever 26 at the front of the toggle lever 27 moves downward, as shown in the drawing; then, catch lever 26 moves from the positioning groove 31 to the penetrated hole 30; when the catch lever is located at the front of the penetrated hole 30, the catch lever 26 loses its function to arrest the side rail 16 of the main ladder 14 of the ladder unit 11; so the ladder unit 11 on the support levers 23 slides out of the housing 10, due to its gravitational force; when the ladder unit 11 moves to a certain distance in front of the housing 10, it is arrested in position by the heads 37; now the ladder unit 11 has moved out of the housing 10, the auxiliary ladder 15 now no longer arrested by the stop levers 32 will smoothly slide down to extend itself, to form an elongated escape ladder, to enable the escapee to climb down on the inside of the ladder unit 11 (between the ladder unit 11 and the housing 10) to escape the hazardous location. Since the length of the ladder unit 11 is specified, the subject invention can be installed to suit the appropriate heights of various floors; if one ladder unit can be installed on each floor at appropriately matching locations, the escapee will be able to select either the press pad 24 or the push lever 29 to drive the control unit 12, to extend the ladder unit 11 in sequential order down to lower floors, thus constituting a series connection of elongated ladders to enable a safe escape to appropriate locations.

The operation of the subject invention is quite simple. Merely by choosing the press pad 24 or the push lever 29 to drive the control unit 12, the ladder unit 11 will automatically slide outward to extend, with its gravitational force; so that with such a simple operational procedure, the extension and installation of the escape ladder can be accomplished within a shortest time, to gain time for the escape and minimize the casualties; when the subject invention is not in use, it can be wholly accommodated inside the housing 10 and sealed by the cover plate 35, so there is no worry of bad effects on the appearance of a building.

Summing up, the subject invention is indeed an unprecedented improvement on the prior art of conventional escape ladders that involve such weaknesses as bad effects on a building's appearance and complicated operational procedures; with its inventive step and originality that will fully satisfy the qualifications for a patent right, this application is filed in accordance with the Patent Law to protect the subject inventor's rights and interests. Your favorable consideration should be appreciated. Should you have any doubts or questions, please feel free to keep the subject inventor advised.

It is hereby declared that the above description, covering merely the preferred embodiment, should not be based to limit or restrict the subject claim, and that all equivalent structural and/or configurational variations and/or modifications made by anyone skilled in the subject trade, deriving from the subject description with drawings and contents therein, should reasonably be included in the intent of the subject invention and the subject claim.

I claim:

1. An escape ladder system for a building structure comprising:

(a) a housing having an inner chamber, said housing having a frame portion defining front and rear windows for open access to said inner chamber and at least a pair of inclined support arm members projecting from said frame portion;

(b) a ladder unit assembly configurable between collapsed and extended configurations removably received in said housing inner chamber, said ladder unit assembly including a main ladder portion and an auxiliary ladder portion displaceably coupled thereto, said ladder portions slidably engaging said support arm members, each said ladder portion having a pair of side rails, said side rails of one said ladder portion respectively engaging in slidable manner said side rails of the other said ladder portion, at least one of said ladder portions having formed thereon at least a pair of stop blocks for engaging the other said ladder portion to limit the relative displacement of said ladder portions, at least one side rail of said main ladder portion having formed therein a positioning recess and a slotted hole adjacent thereto;

(c) a cover plate removably coupled to said housing, said cover plate being adapted to extend substantially over said front window when coupled to said housing, said cover plate having formed therein a plurality of through holes for the passage therethrough of said inclined arm members; and, (d) a control unit assembly coupled to said ladder unit assembly, said control unit assembly including a displaceable catch lever for selectively retaining said ladder unit assembly in said collapsed configuration and actuating the reconfiguration thereof into said extended configuration, said catch lever being adapted to engage said positioning recess of said main ladder portion when said ladder unit assembly is in said collapsed configuration, said catch lever being actuable by a user through said housing;

whereby said ladder unit assembly is released for reconfiguration into said extended configuration upon disengagement of said catch lever from said positioning recess.

2. The escape ladder system as recited in claim 1 wherein a resilient spring member is coupled to at least one of said support arm members for biasing said ladder unit assembly for displacement through said front window of said housing frame portion.

3. The escape ladder system as recited in claim 1 wherein at least one of said support arm members includes a stop arm member transversely protruding therefrom.

4. The escape ladder system as recited in claim 3 wherein at least one side rail of said auxiliary ladder portion has formed therein a substantially L-shaped catch groove having first and second groove parts defined therein, said first groove part receiving said stop arm member when said ladder unit assembly is in said collapsed configuration, said second groove part guiding the disengagement of said stop arm member from said auxiliary ladder portion during said reconfiguration of said ladder unit assembly into said extended configuration.

* * * * *